US011162041B2

(12) United States Patent
Subramaniyam

(10) Patent No.: US 11,162,041 B2
(45) Date of Patent: Nov. 2, 2021

(54) PERFORMANCE ENHANCING ADDITIVE FOR FUEL COMPOSITION, AND METHOD OF USE THEREOF

(71) Applicant: Dorf Ketal Chemicals FZE, Fujairah (AE)

(72) Inventor: Mahesh Subramaniyam, Mumbai (IN)

(73) Assignee: Dorf Ketal Chemicals FZE, Fujairah (AE)

( * ) Notice: Subject to any disclaimer, the term of this patent is extended or adjusted under 35 U.S.C. 154(b) by 0 days.

(21) Appl. No.: 16/965,149

(22) PCT Filed: Jan. 23, 2019

(86) PCT No.: PCT/IB2019/050560
§ 371 (c)(1),
(2) Date: Jul. 27, 2020

(87) PCT Pub. No.: WO2019/150231
PCT Pub. Date: Aug. 8, 2019

(65) Prior Publication Data

US 2021/0040405 A1 Feb. 11, 2021

(30) Foreign Application Priority Data

Jan. 30, 2018 (IN) ..... 201821003542

(51) Int. Cl.
*C10L 1/2387* (2006.01)
*C10L 1/2383* (2006.01)
*C10L 10/18* (2006.01)

(52) U.S. Cl.
CPC ..... *C10L 1/2387* (2013.01); *C10L 1/2383* (2013.01); *C10L 10/18* (2013.01); *C10L 2200/0446* (2013.01); *C10L 2230/22* (2013.01); *C10L 2270/026* (2013.01)

(58) Field of Classification Search
CPC ..... C10L 1/22; C10L 2200/0446; C10L 2230/22; C10L 2270/02; C10L 1/2225; C10L 1/224; C10L 1/2383; C10L 1/2387; C10L 2300/20; C10L 2300/30; C10L 2270/026
See application file for complete search history.

(56) References Cited

U.S. PATENT DOCUMENTS 4,409,000 A 10/1983 LeSuer
2018/0185782 A1* 7/2018 Subramaniyam ..... C08K 5/098

FOREIGN PATENT DOCUMENTS

EP 3091063 A1 11/2016
IN 201821003542 1/2018
WO 2017006199 A1 1/2017
WO 2019150231 A1 8/2019

OTHER PUBLICATIONS

Foreign communication from the priority International Application No. PCT/IB2019/050560, International Search Report and Written Opinion, dated Apr. 29, 2019, 11 pages.
Foreign communication from the priority International Application No. PCT/IB2019/050560, International Preliminary Report on Patentability, dated Apr. 17, 2020, 14 pages.
Foreign communication from the priority International Application No. PCT/IB2019/050560, Written Opinion of the International Preliminary Examining Authority, dated Dec. 12, 2019, 6 pages.

* cited by examiner

*Primary Examiner* — Vishal V Vasisth
(74) *Attorney, Agent, or Firm* — Conley Rose, P.C.; Rodney B. Carroll

(57) ABSTRACT

The present invention relates to performance enhancing additive composition comprising a mixture or a blend of (i) an acid amide; and (ii) oxide treated derivative of amine in one embodiment, and performance enhancing additive composition comprising a mixture or a blend of (i) an acid amide; and (ii) oxide treated derivative of amine, and further comprising a detergent in another embodiment, and to a fuel compositions thereof in still another embodiment, and to method of use thereof in yet another embodiment, and to a method of improving performance of a fuel and an engine in yet another embodiment.

4 Claims, No Drawings

PERFORMANCE ENHANCING ADDITIVE FOR FUEL COMPOSITION, AND METHOD OF USE THEREOF

CROSS REFERENCE TO RELATED APPLICATIONS

This application is a filing under 35 U.S.C. 371 of International Application No. PCT/IB2019/050560 filed Jan. 23, 2019, entitled "Performance Enhancing Additive for Fuel Composition, and Method of Use Thereof," which claims priority to Indian Patent Application No. 201821003542 filed Jan. 30, 2018, which applications are incorporated by reference herein in their entirety.

FIELD OF THE INVENTION

The present invention relates to a performance enhancing additive for fuel composition, a fuel composition comprising performance enhancing additive, and method of use thereof.

BACKGROUND

The modern diesel engines with an injection system have become more energy efficient.

Therefore, the industry needs an additive which can enhance performance of fuel particularly to reduce the power of loss when it is being used in a diesel engine.

Therefore, it is need of the present invention to provide a performance enhancing additive for fuel composition, a fuel composition comprising performance enhancing additive, and method of use thereof.

Problem to be Solved by the Invention

Therefore, the present invention aims at providing a solution to problems of power loss of the modern diesel engines.

OBJECT OF THE INVENTION

Therefore, main object of the present invention is to provide a performance enhancing additive for fuel composition, a fuel composition comprising performance enhancing additive, and method of use thereof.

Other objects and advantages of the present invention will become more apparent from the following description when read in conjunction with examples, which are not intended to limit scope of present invention.

DETAILED DESCRIPTION OF THE INVENTION

With aim to provide a solution to problems of power loss of the diesel engines, the inventor of the present invention has found that when a blend or a mixture of an acid amide and an oxide treated amine is added to a fuel, the resulted fuel composition, surprisingly and unexpectedly, demonstrates improvement in performance of the diesel engine or the fuel by reducing the power loss of the engine.

Therefore, in one embodiment, the present invention relates to a performance enhancing additive composition comprising a mixture or a blend of (i) an acid amide (Component A); and (ii) oxide treated derivative of amine (Component B).

Therefore, in another embodiment, the present invention also relates to use of a performance enhancing additive composition comprising a mixture or a blend of (i) an acid amide (Component A); and (ii) oxide treated derivative of amine (Component B) for improving performance of an engine or the fuel used for engine by reducing the power loss of the engine.

Therefore, in still another embodiment, the present invention relates to a fuel composition comprising (A) a fuel used in modern engine; and (B) a performance enhancing additive composition comprising a mixture or a blend of (i) an acid amide; and (ii) oxide treated derivative of amine.

In accordance with one of the embodiments of the present invention, the acid amide (Component A) is a product of reaction of polyisobutylene succinic anhydride (PIBSA) and tetraethylene pentamine (TEPA).

In accordance with one of the preferred embodiments of the present invention the PIBSA is reacted with the TEPA specifically at a temperature of less than about 100° C.

In accordance with one of the embodiments of the present invention, the oxide treated derivative of amine (Component B) is a product of reaction of an oxide and an amine.

In accordance with one of the embodiments of the present invention, the oxide is selected from a group comprising ethylene oxide (EO), propylene oxide (PO), butylene oxide (BO), and such other oxide.

In accordance with one of the embodiments of the present invention, the amine is preferably a tertiary amine, more preferable a tertiary amine containing one or more hydroxyl groups within the alkyl chain, even more preferably tri-isopropanolamine (TIPA).

Therefore, in accordance with one of the embodiments of the present invention, the oxide treated derivative of amine is selected from a group comprising ethylene oxide (EO) treated derivative of the amine, propylene oxide (PO) treated derivative of the amine, and butylene oxide (BO) treated derivative of the amine.

In accordance with one of the preferred embodiments of the present invention, the oxide treated derivative of amine may be prepared by any known method, preferably by reacting the amine and the oxide taken, respectively, in a weight ratio varying from about 0.5:4 to about 2:16, more preferably by reacting the amine and the oxide taken, respectively, in a weight ratio varying from about 1:8 to about 2:16, even more preferably by reacting the amine and the oxide taken, respectively, in a weight ratio of about 1:8.

In accordance with one of the preferred embodiments of the present invention, the oxide treated derivative of amine is prepared by reacting the amine and the oxide in presence of a hydroxide or alcoholic hydroxide, preferably potassium hydroxide.

In accordance with one of the preferred embodiments of the present invention, the mixture or a blend of (i) an acid amide (Component A); and (ii) oxide treated derivative of amine (Component B) of the present invention may be prepared by mixing or blending the Component A and the Component B in any mole ratio or any weight ratio. For example, the weight ratio of the acid amide and the oxide treated amine may vary from about 99:1 to about 1:99. The oxide treated amine may be obtained by mixing, in mole ratio, the amine to the oxide varying from about 1:1 to about 1:50 moles.

In accordance with one of the embodiments of the present invention, the above-described additive composition may further comprise a detergent (Component C).

Therefore, in still another embodiment, the present invention relates to a performance enhancing additive composition comprising (I) a mixture or a blend of (i) an acid amide (Component A); and (ii) oxide treated derivative of amine (Component B); and (II) a detergent (Component C).

Therefore, in yet another embodiment, the present invention also relates to use of a performance enhancing additive composition comprising (I) a mixture or a blend of (i) an acid amide (Component A); and (ii) oxide treated derivative of amine (Component B); and (II) a detergent (Component C) for improving performance of an engine or the fuel used for engine by reducing the power loss of the engine.

Therefore, in yet another embodiment, the present invention relates to a fuel composition comprising (I) a performance enhancing additive composition comprising a mixture or a blend of (i) an acid amide (Component A); and (ii) oxide treated derivative of amine (Component B); (II) a detergent (Component C); and (III) a fuel used in modern engine.

In accordance with one of the embodiments of the present invention, the detergent is polyisobutylene succinimide (PIBSI).

In accordance with one of the preferred embodiments of the present invention, polyisobutylene succinimide (PIBSI) is a product of reaction of polyisobutylene succinic anhydride (PIBSA) and tetraethylene pentamine (TEPA).

In accordance with one of the preferred embodiments of the present invention the PIBSA is reacted with the TEPA specifically at a higher temperature of more than about 100° C.

In accordance with one of the preferred embodiments of the present invention the PIBSA may be prepared by any known method, preferably it may be prepared from high reactive polyisobutylene (HRPIB).

In accordance with one of the preferred embodiments of the present invention, conventional PIBs and so-called "high-reactivity" PIBs (see for example EP-B-0565285) are suitable for use in present invention. High reactive PIB in this context is defined as a PIB wherein at least 50%, preferably 70% or more, of the terminal olefinic double bonds are of the vinylidene type, for example the GLISSOPAL compounds available from BASF.

It may be noted that in accordance with second embodiment of the present invention, the detergent (Component C) may be mixed or blended with the mixture or the blend of (i) an acid amide (Component A) and (ii) oxide treated derivative of amine (Component B), or alternatively the detergent (Component C) may be mixed or blended with (i) an acid amide (Component A) and (ii) oxide treated derivative of amine (Component B) to form composition of the present invention.

In accordance with one of the preferred embodiments of the present invention, the (i) an acid amide (Component A); (ii) oxide treated derivative of amine (Component B); and (iii) the detergent (Component C) of the present invention may be mixed or blended in any mole ratio or any weight ratio. For example, the weight ratio of the acid amide and the oxide treated amine may vary from about 99:1 to about 1:99. The oxide treated amine may be obtained by reacting the amine and the oxide in mole ratio varying from about 1:1 to about 1:50 moles. Further, the acid amide:the oxide treated amine:the detergent may be mixed or blended in a weight ratio varying from about 1:0.1:0.1 to about 0.1:1:1.

Therefore, in yet another embodiment, the present invention also relates to a method for improving performance of a fuel used in an engine and of an engine by reducing the power loss thereof by employing the performance enhancing additive compositions of the present invention.

In one of the exemplary embodiments, the detergent of the present is polyisobutylene succinimide (PIBSI), which may be prepared by a method known in the art. Preferably, the PIBSI may be prepared by following two step reaction.

Step-1: Synthesis of Polyisobutylene Succinic Anhydride (PIBSA): (not an Invention):

a) About 1297.5 g of high reactive polyisobutylene (HRPIB) having 750 molecular weight as commercially available was charged in a clean and dry four necked flask. The temperature was raised to about 125° C.;
b) About 201.8 g of maleic anhydride was added and the resulted reaction mixture was further heated to a temperature of about 170° C. for about 2 hr;
c) The reaction mixture was further heated to about 205° C. for about 3 h and was maintained at the same temperature, i.e. at a temperature of about 205° C. for about 6 hr;
d) Thereafter, excess maleic anhydride was distilled out;
e) The reaction mixture was diluted with toluene to obtain PIBSA, which is found to be 85% active in toluene.

Step-2: Synthesis of Polyisobutylene Succinimide (PIBSI) from PIBSA of Step-1—[Referred to as PDA1 in the Examples]:

A clean and dry four necked flask was charged with about 400 g of 85% active PIBSA in toluene as obtained in above Step-1, and about 76.1 g of TEPA was added thereto with continuous stirring at room temperature. The reaction mixture thus resulted was then heated to a temperature of about 140° C. to 150° C., preferably for the present example, it is heated to a temperature of about 145-147° C. and maintained at this temperature for about 4 hrs so as to complete the reaction to form a cyclic ring compound—PIBSI. Thereafter, toluene was completely distilled out. The reaction mixture was diluted with heavy aromatic solvent (HAR), which for the present example is solvent naphtha, to obtain the cyclic ring compound—PIBSI, which was found to have:

Average molecular weight ($M_w$) of about 750 Daltons as measured by gel permeation chromatography (GPC);
7% nitrogen contents as calculated by elemental analysis; and
Total amine value of about 133 mg KOH/g as calculated by ASTM D 2074-16 method.

In one of the exemplary embodiments, the acid amide of the present is a product of reaction of polyisobutylene succinic anhydride (PIBSA) and TEPA, which may be prepared by a method known in the art. Preferably, the acid amide may be prepared by following reaction.

Step-A: Synthesis of Acid Amide (Component A):

In a clean and dry four necked flask, to about 200 g of 85% active PIBSA in toluene as obtained in above Step-1, about 40.18 g of TEPA was added under stirring at room temperature. The reaction mixture thus resulted was heated to a temperature of about 60° C. to about 100° C., preferably to about 70° C. to about 90° C., for the purpose of present example, particularly to about 80° C. and was maintained for a duration varying up to about 7 hrs, preferably up to about 7 hrs, for the purpose of present example, particularly up to about 5 hrs. It may be noted that the present reaction may also be carried out at a room temperature, but not at a temperature above 100° C. because then a cyclic ring compound—PIBSI of above Step-2 would be formed, and aim of the present example it to avoid formation of the cyclic ring compound—PIBSI of above Step-2. Thereafter, toluene was distilled out to obtain an acid amide, which for the present invention is identified as a Component A. The Component A (acid amide) was found to have:

Acid value of about 18 mg KOH/g as calculated by ASTM D664-16 method;
5% of nitrogen contents as calculated by elemental analysis; and Total amine value of about 123 mg KOH/g as calculated by ASTM D 2074-16 method.

Step-B: Preparation of PO-TIPA Derivative (Component B):

About 437 gm of TIPA was charged in an autoclave to which about 7.5 gm of potassium hydroxide (KOH) was added and the resulted reaction mixture was heated to a temperature of about 130° C. to which about 1062.5 gm of PO was added. The temperature of the resulted reaction mixture was maintained at a temperature of about 130° C. for about 2-3 hr so as to result in formation of PO-TIPO derivative. The reaction mixture was cooled to room temperature (RT) and the PO-TIPA derivative was isolated, which for the present invention is identified as a Component B. The Component B (PO-TIPO derivative) was found to have:

3% of nitrogen contents as calculated by elemental analysis; and

Total amine value of about 91 mg KOH/g as calculated by ASTM D 2074-16 method.

Preparation of a Mixture or a Blend of the Component A and the Component B:—[Referred to as PDA7 in the Examples]:

In one of the exemplary embodiments of the present invention, a mixture or a blend of the Component A and the Component B may be prepared by following process [referred to as PDA7 in the examples]

About 150 g of the Component A (acid amide) as obtained in above STEP-A was charged in a clean and dry four necked flask to which about 95 g of the Component B [PO-TIPA derivative as obtained in above STEP-B from TIPA: PO taken in about 1:8 weight ratio] was added and the resulted reaction mixture was heated to a temperature of about 78-80° C. for about 4 h. It was observed that this results in formation of two separate layers confirming that no chemical reaction took place between the Component A and the Component B of the present invention even on heating the reaction mixture thereof to a temperature of about 78-80° C. for about 4 h.

Upon analysis of these two separate layers, it was found that mixing and heating of the Component A and the Component B did not result in formation of a quaternary salt, and hence, confirms no chemical reaction occurred between the Component A and the Component B of the present invention.

For one of the exemplary embodiments of the present invention, the above-said two separate layers, thus formed, were diluted with toluene to have 50% activity which resulted in formation of a homogenized single layer, i.e. a mixture or a blend of the Component A and the Component B, which is the mixture or a blend of the present invention.

Analysis of the Mixture or the Blend of 50% Active Component a and 50% Active Component B:

Acid value of about 5 mg KOH/g as calculated by ASTM D664-16 method;

3% Nitrogen content as calculated by elemental analysis; and

Total Amine Vale of about 65 mg KOH/g as calculated by ASTM D 2074-16 method.

Abbreviations:

In the present invention, following abbreviations have been used:

TIPA is tri-isopropanolamine;

PO-TIPA is propylene oxide (PO) derivative of TIPA;

750 PIBSI is polyisobutylene succinimide having average molecular weight ($M_w$) of 750 Daltons;

HRPIB is high reactive polyisobutylene;

TEPA is tetraethylene pentamine;

PIBSA is polyisobutylene succinic anhydride; and

HAR is heavy aromatic solvent.

Accordingly, in one embodiment, the performance enhancing additive composition of the present invention comprises a mixture/blend of (i) acid amide (i.e. a product of reaction of PIBSA & TEPA, that is, Component A of Step A); and (ii) oxide treated derivative of TIPA, such as PO-TIPA derivative (i.e. a product of TIPA & PO, that is, a Component B of Step-B).

Accordingly, in second embodiment, the performance enhancing additive composition of the present invention comprises a mixture/blend of (i) acid amide (i.e. a product of reaction of PIBSA & TEPA, that is, Component A of Step A); and (ii) oxide treated derivative of TIPA, such as PO-TIPA derivative (i.e. a product of TIPA & PO, that is, a Component B of Step-B); and further comprises (iii) PIBSI as a detergent (Component C).

Further embodiments of the present invention would be apparent from the accompanying examples, which are for the illustration purpose and not intended to limit scope of the present invention.

Examples

Various diesel fuel compositions were prepared to evaluate the efficiency of the presently provided additive compositions by using a commercially available reference fuel suitable for the test method used. For example, for CEC-F-98-08 test method, one may use CEC RF-79-07 reference fuel as commercially available. Such reference fuel is known to have cetane number of about 52 to about 54 as measured by EN ISO 5165 method, density at 15° C. of about 833 to about 837 Kg/m$^3$ as measured by EN ISO 12185 method, flash point of about 62° C. or more as measured by EN ISO 2719 method, viscosity at 40° C. of about 2.300 to about 3.300 mm$^2$/s as measured by EN ISO 3104 method. One may also use CEC RF 06 03 reference fuel as commercially available. Such reference fuel is known to have cetane number of about 52 to about 54 as measured by EN ISO 5165-98 method, density at 15° C. of about 833 to about 837 Kg/m$^3$ as measured by EN ISO 3675-98 method, flash point of about 55° C. or more as measured by EN ISO 22719 method, viscosity at 40° C. of about 2.3 to about 3.3 mm$^2$/s as measured by EN ISO 3104 method. To these exemplary compositions, about 1 ppm zinc as zinc neodecanoate was added. The resulted compositions were tested by CEC-F-98-08 method. For these experiments, the CEC RF-79-07 reference fuel, which is the standard reference fuel nominated by the Coordinating European Council (CEC) for the CEC-F-98-08 engine test method was used. It may be noted that scope of the present invention is neither limited by the test method nor limited by the reference fuel used for the test method.

In the following exemplary compositions, the PDA1 and PDA7 are same as described herein above.

TABLE 1

| Expt. No. | Fuel Composition | Total neat additive (in ppm) | % Power Loss |
|---|---|---|---|
| 1. | Base fuel RF79, no additive | | 4.7 |
| 2. | Base fuel RF79 with 74 ppm of PDA1 | 74 | 2.3 |
| 3. | Base fuel RF79 with 31 ppm of PDA1 and 25 ppm of PDA7 | 56 | 2.3 |
| 4. | Base fuel RF79 with 100 ppm of PDA7 | 100 | 0.9 |
| 5. | Base fuel RF79 with 50 ppm of PDA7 | 81 | 0.7 |

TABLE 1-continued

| Expt. No. | Fuel Composition | Total neat additive (in ppm) | % Power Loss |
|---|---|---|---|
| | and 31 ppm of PDA1 | | |
| 6. | Base fuel RF79 with 50 ppm of PDA7 and 62 ppm of PDA1 | 112 | 0.5 |

As can be observed from the test results of above Table 1, the base fuel with 74 ppm of additive PDA1 shows 2.3% power loss; the base fuel with 100 ppm of additive PDA7 shows substantially lower % power loss of 0.9% power loss, wherein addition of the PDA1, i.e. detergent to the additive PDA7 results in further substantial reduction in % power loss to 0.7% or 0.5% power loss. Therefore, the compositions of the present invention have demonstrated surprising and unexpected technical advantages, i.e. the synergistic effects.

As can be observed from the test results of above Table 1, the compositions of the present invention comprising PDA7, or PDA7 and PDA1, have demonstrated improvement in performance by reducing the % power loss as compared to blank sample, and samples consisting of prior art additive, i.e. PDA1 without the additive composition of the present invention.

The invention claimed is:

1. A performance enhancing additive composition consisting of a mixture or a blend of:

(i) an acid amide; and (ii) oxide treated derivative of amine;

wherein the acid amide consists of a reaction product of polyisobutylene succinic anhydride (PIBSA) and tetraethylene pentamine (TEPA);

wherein the oxide treated derivative of amine consists of a reaction product of an oxide and an amine; and wherein the amine consists of tri-isopropanolamine (TIPA);

wherein the oxide consists of propylene oxide (PO);

wherein the oxide treated derivative of amine consists of propylene oxide treated derivative of tri-isopropanolamine (PO-TIPA).

2. A method of using a performance enhancing additive composition for enhancing performance of an engine or fuel used for the engine by reducing power loss of the engine, wherein the method comprises using a performance enhancing additive composition as claimed in claim 1 in the engine or the fuel used for the engine.

3. A method for improving performance of an engine or a fuel used for the engine by reducing the power loss of the engine, wherein the method comprises adding the performance enhancing additive composition as claimed in claim 1 to the engine or the fuel used for the engine.

4. A fuel composition comprising:

(A) an engine fuel; and (B) the performance enhancing additive composition as claimed in claim 1.

* * * * *